United States Patent [19]

Enyedy et al.

[11] Patent Number: 4,918,356

[45] Date of Patent: Apr. 17, 1990

[54] ELECTRIC INCANDESCENT LAMP AND METHOD OF MANUFACTURE THEREFOR

[75] Inventors: Edward A. Enyedy, Eastlake; Richard L. Hansler, Pepper Pike, both of Ohio

[73] Assignee: General Electric Company, Schenectady, N.Y.

[21] Appl. No.: 243,371

[22] Filed: Oct. 17, 1988

[51] Int. Cl.[4] ..... H01K 1/18; H01K 1/40; H01K 3/06

[52] U.S. Cl. ..... 313/579; 313/271; 313/274; 445/27; 445/32

[58] Field of Search ..... 313/578, 579, 271, 274; 445/23, 27, 32, 48, 35, 49

[56] References Cited

U.S. PATENT DOCUMENTS

| | | | |
|---|---|---|---|
| 4,389,201 | 6/1983 | Hansler et al. | 445/26 |
| 4,535,269 | 8/1985 | Tschetter et al. | 313/579 |
| 4,588,923 | 5/1986 | Hoegler et al. | 313/579 |
| 4,835,443 | 5/1989 | Benson et al. | 313/579 |

*Primary Examiner*—Kenneth Wieder

*Attorney, Agent, or Firm*—John P. McMahon; Stanley C. Corwin; Fred Jacob

[57] ABSTRACT

An electric incandescent lamp having improved means for both physically positioning and controlling the light output from a filament light source is disclosed. The lamp construction can further employ a reflective film for improved efficiency of lamp operation while a halogen substance can also be included in the inert gas filling for this purpose. A method to manufacture the disclosed lamp improvement is also provided.

29 Claims, 2 Drawing Sheets

ELECTRIC INCANDESCENT LAMP AND METHOD OF MANUFACTURE THEREFOR

BACKGROUND OF THE INVENTION

This invention relates generally to electric incandescent lamps of the type which provide radiant energy efficiently and more particularly to a structural configuration for the filament light source means employed in this type lamp to improve its operating efficiency.

A wide variety of electric incandescent lamps are already known which employ a refractory metal filament as the light source to provide general illumination. With the original A-line household lamps of this type, a coiled tungsten filament is commonly employed having opposite end turns extending outwardly along the central coil axis and which are physically clamped for support by refractory metal lead-in wires. If the clamping is too tight it can produce broken filaments while too loose clamping can result in erratic electrical contact producing flicker or electromagnetic interference. A further serious problem arises during customary manufacture wherein the lamps is "flashed" to provide a recrystallized grain structure in the assembled filament. A transition zone of uncrystallized refractory metal often occurs at the junction site of clamping which is also recognized to enhance mechanical breakage of the supported filament. It would be understandably desirable to eliminate or minimize all such problems with utilization of a coiled refractory metal filament in an electric incandescent lamp.

Recent development of increasingly more energy efficient electric incandescent lamps places a far greater requirement upon physical location of the refractory metal incandescent filament in the lamp envelope. For example, one known lamp emits selectively in both the infrared and visible spectral regions with such lamp providing studio lighting having a daylight color. A representative structural configuration for said type lamp is disclosed in U.S. Pat. No. 4,588,923, assigned to the assignee of the present invention, and wherein the selective radiant energy distribution from the lamp is achieved with a reflective film deposited on the elongated lamp envelope. As can be noted from the description appearing in said commonly assigned prior art patent, the optical pass-band and the stop-band characteristics selected for said reflective film medium serve to reflect infrared radiation back to the lamp filament. The filament operating efficiency can be increased in this manner for more efficient light output from the lamp since the reflective film is selected so as to still transmit a major portion of the desired visible radiation. The above mentioned patent is specifically incorporated herein by reference, therefore, due to the same reflective film characteristics which can be employed in one embodiment of the present lamp improvement. The doubled ended lamp construction disclosed in said prior art patent is further reported to mechanically and electrically connect an elongated tungsten filament extending substantially the full length of a tubular lamp envelope with lead-in wires joined thereto by known "spudding" techniques. Such joinder of the filament coil to the lead-in wire conductors is customarily provided by inserting one end of a lead-in wire length into the central coil opening and thereafter welding the inserted end to a number of the end coil turns. In doing so, it can be appreciated that the lighted length of the coil filament may vary widely especially due to melting of the lead-in refractory metal which can short circuit a variable number of these end turns. While such method of securing a coiled filament to its lead-in conductors has proven acceptable, as evidenced by current wide scale commercial practice, it still remains difficult to assemble the lead-in conductors into both ends of a filament coil with ease and high reliability. Accordingly, it remains desirable to provide such type filament assembly in a manner enabling more precise determination of the lighted length for the assembled filament coil as well as enabling said light source to be conveniently and accurately positioned within the lamp envelope during lamp manufacture.

It is a principal object of the present invention, therefore, to provide a more reliable coiled filament assembly in an electric incandescent lamp employing an elongated hermetically sealed light transmissive envelope and in a manner producing an improved light source.

It is another important object of the present invention to provide improved filament connection means in such type electric incandescent lamps enabling a coiled refractory filament to be aligned substantially coincident with the longitudinal axis of the lamp envelope in a convenient simple manner.

Still another important object of the present invention is to provide more effective engagement between the filament member and its lead-in conductors which better controls centering of the assembled filament within the lamp envelope.

A still further important object of the present invention is to provide an improved coiled filament assembly in said type electric incandescent lamp enabling still more reliable lamp manufacture, particularly with high speed automated lamp manufacturing equipment.

These and other objects of the present invention will become more apparent upon consideration of the following description for the present invention.

SUMMARY OF THE INVENTION

Novel connection of the lead-in conductors to a coiled filament in an electric incandescent lamp has now been discovered which improves centering of the filament coil within the lamp envelope as well as better controlling the light output from this light source. More particularly, such improvement is provided with lead-in conductors having an L-shaped configuration and which are connected to opposite single end turns of the filament coil in a specific manner. A welded connection between one leg of such lead-in conductor elements and a predetermined location on the circumference of a single filament coil end turn joined thereto avoid electrical shorting of adjacent coil turns. Limiting fusion between the refractory metals employed for the filament coil and lead-in conductors to a single end turn of the filament coil is provided with a known welding process selected from the group consisting of plasma welding and laser welding. Each remaining free leg of the joined lead-in conductor elements is disposed substantially parallel to the central axis of the coil filament and with such alignment being desirably coincident with the central axis of the filament coil. A non-coincident alignment therebetween can still be tolerated in the lamp manufacture to be hereinafter more fully described, however, wherein compensation for such misalignment can be provided to secure further desired placement of the filament coil along the longitudinal lamp axis. A still further advantage achieved with the present light source is control of the lighted length in the filament coil by means of the relative location of the lead-in conductors joined thereto. In this regard, it is contemplated that alignment of the respective lead-in conductors on the circumferential edge of the filament coil can be offset with respect to each other thereby providing a means for either shortening or lengthening the effective lighted length of the filament coil, if desired. Providing a light source in the foregoing manner thus enables the lighted length of the filament coil to be more accurately centered within an elongated lamp envelope with respect to both its longitudinal lamp axis as well as in directions transverse thereto.

In one preferred lamp embodiment, an electric incandescent lamp is provided comprising in combination an elongated hermetically sealed light transmissive lamp envelope containing an inert gas filling, an incandescent refractory metal coiled filament having a linear axis substantially coincident with the longitudinal axis of the lamp envelope and extending substantially the full length of the lamp envelope, and lead-in conductors sealed through opposite ends of the lamp envelope and each joined directly to opposite single end turns of the coil filament. The lead-in conductors each comprising refractory metal wire lengths having a bent end joined to the single end turn at a circumferential edge location with the opposite free end extending outwardly and being aligned substantially parallel to the longitudinal axis of the lamp envelope. The filament coil in this lamp is preferably tungsten while the lead-in conductors are molybdenum although it is also contemplated that lead-in conductors of tungsten can also be used. As herein before indicated, said lead-in conductors are joined directly to the filament coil by a welding process selected from the group consisting of plasma welding and laser welding which avoids objectionable weld splatter to adjacent coil turns when such joinder is made. The preferred lamp embodiment further employs a reflective film deposited on the surface of the lamp envelope for improved operating efficiency since the filament coil emits both in the visible and infrared spectral regions. As disclosed in the aforementioned prior art patent, this reflective film is capable of operating at a temperature in the range up to and including 950° C. with said film being formed of a plurality of layers exhibiting high and low optical refractive indices of refractory materials effective to establish a pass-band characteristic and a stop-band characteristic providing the selective radiant energy distribution above specified. The coiled refractory metal filament in said lamp extends the axial length of the lamp envelope while being mechanically and electrically connected at both ends to the in-lead conductors hermetically sealed at the envelope ends. In a preferred method of manufacture for such lamp construction, a pre-assembly of the lamp filament coil and lead-in conductors is first effected as above specified and said pre-assembly thereafter inserted into one end of the cylindrical lamp envelope tube. A fill of inert gas which preferably contains a relatively small quantity of a halogen substance to further improve lamp operating efficiency is added to the lamp envelope all in an otherwise conventional lamp manufacturing manner. Hermetically sealing both ends of the lamp envelope at the in-lead conductor locations completes said lamp manufacture with the filament coil being maintained by such support means at the center of the envelope cylinder and extending along its axial length.

In a different preferred lamp construction utilizing the present improved light source means, there is employed an ovoid shaped lamp envelope again preferably having the reflective film deposited on the exterior surface of said lamp envelope to improve lamp operating efficiency. To better establish maximum optical cooperation between said reflective film and a tungsten coil filament extending substantially the full length of said lamp envelope, it becomes essential for the filament coil to be centered within said lamp envelope to an accuracy of approximately one percent. Since the present lamp embodiment is again of such high efficiency type, the elevated lamp operating temperatures further requires the lamp envelope to be formed with a relatively refractory light transmissive substance such as fused quartz, aluminosilicate glass or silicate borate glass. The latter requirement further dictates utilization of a particular end seal means for the present filament coil assembly which closley match the thermal expansion characteristics of the selected lamp envelope material. Thus, depending on the particularly refractory metal wire chosen for a lead-in conductor as well as its wire diameter, such selection can require in both of the herein described lamp embodiments that the free end of the lead-in conductor be first joined to a thin refractory metal foil element in order to achieve the desired hermetic seal. Suitable manufacture of such modified lamp construction again comprises forming a preliminary filament assembly having the filament coil joined directly to the lead-in conductors and foil elements, inserting the filament assembly into one end of the lamp envelope and hermetically sealing both ends of the foil elements by various already known techniques. This type manufacture can be carried out as generally disclosed in U.S. Pat. No. 4,389,201, also assigned to the present assignee, in so far as employing similar manufacturing equipment as therein disclosed together with the further disclosed gas filling and hermetic sealing steps of the manufacture.

DETAILED DESCRIPTION OF THE PREFERRED EMBODIMENTS

Figure 1:
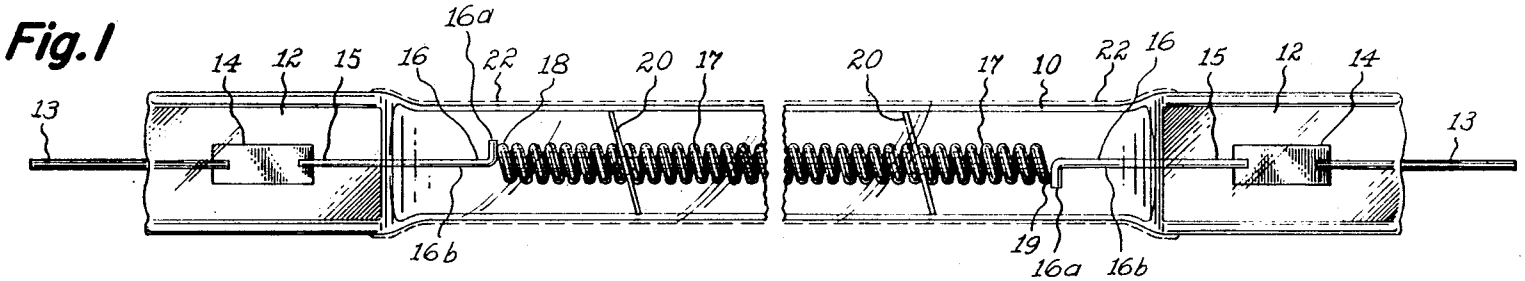
FIG. 1 is a side view depicting one lamp construction embodying the presently improved light source means.

Referring to the drawings, a lamp is depicted in FIG. 1 employing the same general construction as disclosed in the aforementioned U.S. Pat. No. 4,588,923 patent. Accordingly, said lamp includes a radiation transmissive envelope 10 having an elongated tubular shape and fabricated to a clear fused quartz, or translucent fused quartz, or quartz-like glass such as that known commercially as VYCOR available from the Corning Glass Works. Although the tubular envelope depicted in FIG. 1 is a double ended type, practice of the present invention further contemplates a single-ended type elongated lamp envelope as hereinafter more fully described. Typical dimensions for a suitable double ended type quartz envelope can be 3×5 millimeter diameter quartz tubing having a 20 millimeter length. Each end of said lamp 10 has a pinched portion 12 through which is sealed a lead-in conductor 13 connected to another lead-in conductor 15 by a thin intermediate foil portion 14 which is hermetically sealed and embedded in the pinch portion 12. The foil portion 14 may be a separate piece of molybdenum welded to one end of each of the lead-in conductors 13 and 15. Alternately, the foil portion 14 can be an integral portion of a single length of molybdenum wire. Further, for glass type tubular envelope 10 the lead-in conductors 13 and 15 may be a single rod type member not having foil portion 14, for a straight through entrance into tubular envelope 10. In accordance with the present invention, both lead-in conductors 15 have a bent construction enabling a direct individual joinder to a single end turn of a coiled coil type tungsten filament 17 extending through the axial length of the lamp envelope. The depicted lead-in conductors 15 each employ an L shaped configuration 16 wherein one leg 16*a* is affixed at a predetermined location on the circumference of the single coil end turn joined thereto, 18 or 19, while the remaining free leg 16*b* of said individual lead-in conductors are both disposed substantially parallel to the central axis of the filament coil for joinder to the individual foil elements 14 being utilized in the depicted lamp construction. As seen in FIG. 1, the exterior surface of the bent end 16*a* of the L shaped conductors 16, which faces the filament 17, contacts and is joined to the circumference of the single coil end turn 18 or 19. A fine size tungsten wire diameter can be employed for a lamp to be operated at household voltages with the coil length and pitch being further determined in a conventional manner by the rated lamp wattage, such as 90 watts for the representative lamp embodiment herein being depicted. Said filament coil 17 is shown to be further physically supported by a plurality of tungsten support elements 20 which are optionally provided depending on the relative coil length. A reflective film 22 cover the outer surface of the lamp envelop 10 to provide means whereby a major portion of the visible radiation being emitted by said lamp filament 17 is transmitted outwardly from said lamp envelope 10 whereas a major portion of the infrared radiation being emitted by said lamp filament is reflected by said reflective film back toward said filament. As more fully explained in the above mentioned U.S. Pat. No. 4,588,923, said reflective film 22 exhibits the necessary pass-band and stop-band optical characteristics for such operative association with the lamp filament 17 and also makes it essential for maximum benefit that said filament remain accurately centered in the lamp envelope throughout its operating lifetime.

Figure 2:
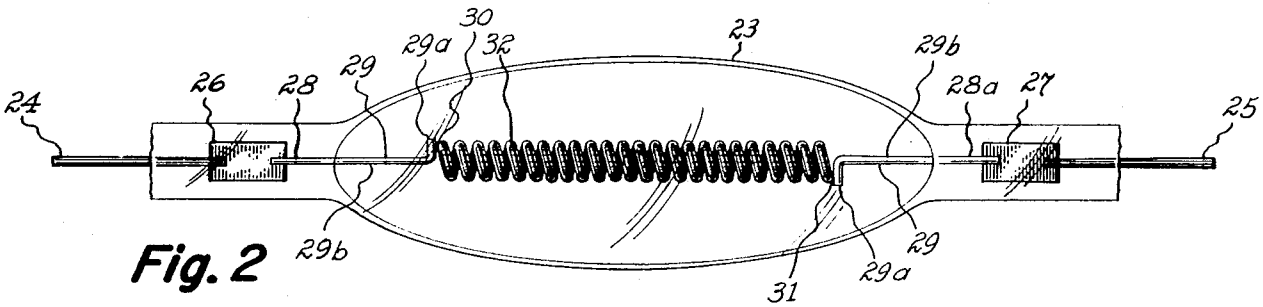
FIG. 2 is a side view for a different lamp construction employing such improved light source means.

In FIG. 2 there is shown a different preferred lamp construction embodying the presently improved light source means. Specifically said lamp includes an ovoid shaped fused quartz envelope 23 of the double ended type and with both ends of said lamp envelope employing the pinched-sealed construction hereinbefore described in the preceding embodiment. An alternative hermetic sealing technique described in the aforementioned U.S. Pat. No. 4,389,201 can also be employed wherein both ends of the quartz envelope are fused causing the quartz to collapse and seal to the refractory metal components at said locations. Each lamp termination thereby features in-lead conductors 24 and 25 connected at one end to refractory metal foil elements 26 and 27, respectively, and which are connected at opposite ends to internal in-lead conductors 28 and 28*a*. The latter in-lead conductors again employ an L shaped configuration 29 having one leg element 29*a* welded to a circumferential edge of the exteriormost end turns 30 or 31 of filament coil 32 while the remaining free leg 29*b* of said individual internal lead-in conductors are affixed to the intermediate foil elements 26 or 27. As seen in FIG. 2, the exterior surface of the bent end 29*a* of the L shaped conductors 28 and 28*a*, which faces the filament 32 contacts and is joined to the circumference of the single coil end turn 30 or 31. As can be noted in the present drawing, the leg elements 29*b* for said internal lead-in conductors are aligned substantially coaxial with the longitudinal axis of the lamp envelope 23 thereby enabling the light source to be centered within the internal cavity. The same results can be achieved during lamp manufacture despite not having an exact alignment coincidence for the internal lead-in conductors 29 so long as the free end thereof 29*b* remains substantially parallel to the lamp longitudinal axis. It should be further recognized in connection with both illustrated lamp embodiments that relative rotation of the leg elements (either 16*a* or 29*a*) when being welded to opposite ends of its filament coil can also be employed during lamp manufacture as additional means to modify the light output in the present lamp improvement. To further illustrate such modification in connection with the presently illustrated lamp embodiment, the leg element 29*a* of depicted internal lead-in conductor 28 can be joined to single end turn 30 with said leg element extending vertically upward as shown in the drawing. A relative rotation of leg element 29*a* for the remaining internal lead-in conductor 28*a* when being joined to single end turn 31 at the opposite end of the filament coil 32, such as having said leg element now extend horizontally will alter the lighted length of said light source. Accordingly, it can be appreciated that the present lead-in conductor members not only enable the filament light source to be centered with respect to the lamp longitudinal axis but can impart further desired centering along said axis as well as obtain more precise control of lamp watt lumens and life by controlling the lighted filament length.

Figure 3B:
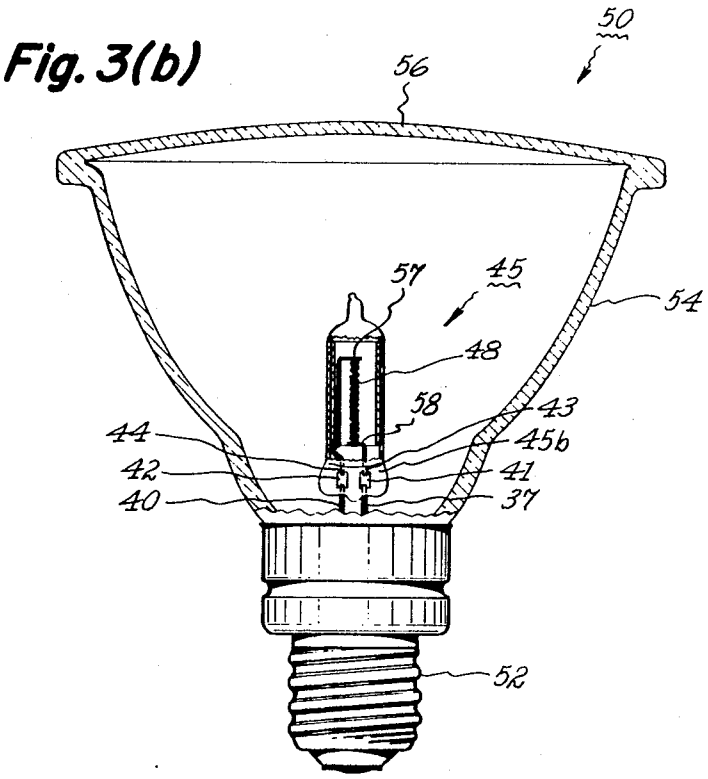
FIGS. 3(*a*) and 3(*b*) depict still further incandescent lamp embodiments constructed in accordance with the present invention.
Figure 3A:
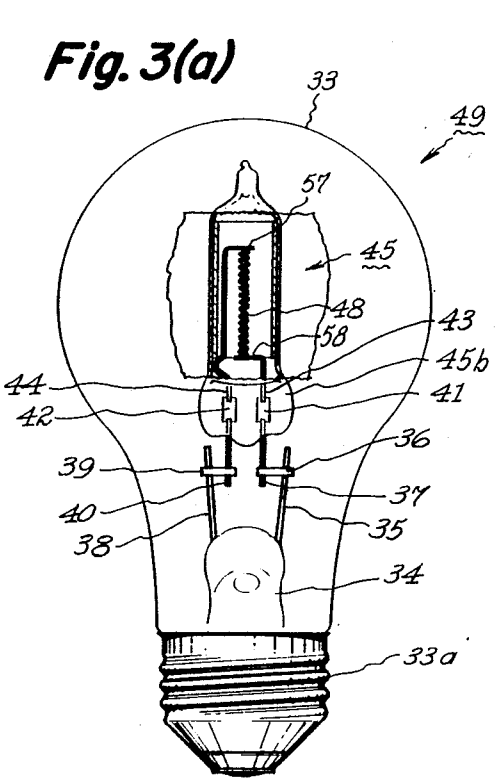

A small further need related to optical considerations arises when the filament light source is lodged within a related lighting device to assure that the light being emitted by the filament can be predeterminately and advantageously directed by the lighting device into a desired light beam pattern. Accordingly, there are depicted in FIGS. 3(*a*) and 3(*b*) two representative incandescent lamp embodiments each employing an outer bulb filled with an inert gas or evacuated and an inner lamp envelope containing a halogen atmosphere along with a relatively high pressure fill gas. The inner elongated lamp envelope has on one of its surfaces an infrared reflective film which is operatively associated with a tungsten filament disposed along the longitudinal axis of this envelope. The FIG. 3(*a*) incandescent lamp 32 includes an outer envelope 33 sealed to an electrically conductive base 33*a*. The outer envelope 33 has spatially disposed in a coaxial manner a single ended generally cylindrical inner envelope 45. The inner envelope 45 has a pair of lead-in conductors 37 and 40 which are ridgedly affixed to a stem 34. The lead-in wire 37 is affixed to the stem 34 by a cross-member conductor 36 having one end connected to in-lead 37 and the other end connected to conductor 35 which extends through stem 34 and which is connected to the appropriate portion of the electrically conductive base 33*a*. Lead-in wire 40 is affixed to stem 34 by a cross-member conductor 39 having one end connected to in-lead 40 and the other end connected to conductor 38 which extends through stem 34 and is connected to the appropriate portion of the electrically conductive base 33*a*. The inner envelope 45 of the present invention shown within the general service incandescent lamp 32 of FIG. 3(*a*) is also applicable to another embodiment shown in FIG. 3(*b*) with a PAR lamp 50. Accordingly, the same numerals have been retained for said inner lamp envelope in the FIG. 3(*b*) lamp embodiment.

The PAR lamp 50 of FIG. 3(*b*) has a generally frustoconical side portion 54 and a relatively flat top lens portion 56 as shown in a partially exposed manner so as to illustrate the location of the inner envelope 45 therein. The inner envelope 45 is centrally positioned adjacent to the base of the PAR lamp 50 and the lead-in conductors 37 and 40 are electrically connected (not shown) to the electrically conductive base 52 thereof. The filament 48 within the inner envelope 45 is located within lamp 50 so as to be predeterminately aligned in a longitudinal manner relative to the focal point of the parabolic lamp 50. More particularly, the mid-section of the filament 48 is aligned in a longitudinal manner to within ±7.5 millimeters of the focal point of lamp 50. This alignment provides, in part, the desired optical light transmission characteristics of lamp 50. Still further with regard to said lamp filament 48, it is advantageous from an optical view point to have the length of said filament held to a relatively small value so that it acts as point source for emitting the incandescent light of the lamp 50. As further depicted with respect to both FIGS. 3(*a*) and 3(*b*) embodiments, the lead-in wires 37 and 40 are respectively connected to molybdenum foil elements 42 and 41 and encapsulated within a pinch seal region 45*b* of the inner envelope 45. The molybdenum foil elements 42 and 41 are respectively connected to conductors 43 and 44. Said molybdenum foil elements 42 and 41 have flat-like structure and are commonly utilized to provide a proper sealing within pinch seal region 45*b* when a quartz tube is used to form the inner envelope 45. However, if a glass-like tube is used to form inner envelope 45 the lead-in wires 37 and 40 may each be rod-like for entrance into inner envelope 45 to obviate further need for the molybdenum foil elements 41 and 42 and also the conductors 43 and 44. As can be further particularly noted from the drawings for both FIGS. 3(*a*) and 3(*b*) lamp embodiments, the inner envelope 45 employs internal lead-in conductors each having an L shaped configuration and with respective leg portions 57 and 58 being joined directly to opposite single end turns of the coiled filament 48 in the same manner as described for the previously disclosed lamp embodiments.

It will be apparent from the foregoing description that a generally improved electric incandescent lamp construction has been provided to enable greater efficiency of lamp operation. It will be apparent that modifications can be made in the specific contour and physical features of a particular lamp design of this type without departing from the spirit and scope of the present invention. For example, a lamp having an elongated envelope with a bulbous spherical midportion is contemplated as is modification of any reflective film being employed to vary the color of visible radiation being emitted from the lamp. Additionally, filament coils other than the coiled coil filament selected in the above specifically disclosed lamp embodiments can as readily be joined to the present lead-in members with comparable results. Consequently, it is intended to limit the present invention only by the scope of the appended claims.

What we claim as new and desire to secure by Letters Patent of the United States is:

1. An electric incandescent lamp comprising, in combination, an elongated hermetically sealed light transmissive lamp envelope containing an inert gas filling, an incandescent refractory metal coiled filament having a linear axis substantially coincident with the longitudinal axis of the lamp envelope and extending substantially the full length of the lamp envelope, and lead-in conductors sealed through opposite ends of the lamp envelope and each joined directly to opposite single end turns of the coiled filament, the lead-in conductors each comprising refractory metal wire having a bent end with its exterior surface facing the filament which is joined to the single end turn at a circumferential edge location with the opposite free end of each conductor extending outwardly and being aligned substantially parallel to the longitudinal axis of the lamp envelope, said bent end joined to said filament so as to avoid electrical shorting between adjacent turns of said filament.

2. The lamp of claim 1 wherein the inert gas filling further includes a relatively small quantity of halogen gas.

3. The lamp of claim 1 which further includes a reflective film being located on the surface of the lamp envelope.

4. The lamp of claim 3 wherein the reflective film employs a pass-band and stop-band characteristic such that a major portion of the desired visible radiation being emitted by the coiled filament is transmitted outwardly from the lamp envelope whereas a major portion of the infrared radiation being emitted by the coiled filament is reflected by the reflective film backwardly toward the filament.

5. The lamp of claim 1 wherein the coiled filament comprises a coiled coil construction.

6. The lamp of claim 1 wherein the coiled filament is tungsten.

7. The lamp of claim 6 wherein the lead-in conductors are molybdenum.

8. The lamp of claim 1 wherein both the coiled filament and lead-in conductors are tungsten.

9. The lamp of claim 1 wherein the lead-in conductors are joined directly to the coiled filament by a welding process selected from the group consisting of plasma welding and laser welding.

10. The lamp of claim 8 wherein the coiled filament exhibits a recrystallized grain structure substantially devoid of uncrystallized tungsten after the lamp is given a customary heat treatment.

11. The lamp of claim 1 wherein the free end of at least one lead-in conductor is aligned substantially coincident with the longitudinal axis of the lamp envelope.

12. The lamp of claim 1 wherein the free end of both lead-in conductors are aligned substantially coincident with the longitudinal axis of the lamp envelope.

13. The lamp of claim 1 wherein the alignment of the respective lead-in conductors is offset with respect to each other.

14. The lamp of claim 1 wherein the free end of each lead-in conductor is joined to refractory metal foil elements and with the foil elements being fusion sealed to the lamp envelope.

15. Light source means for an electric incandescent lamp which comprises a coiled refractory metal incandescent filament in the form of an elongated coil having a central axis with refractory metal wire lead-in conductors being directly joined to the filament coil at both ends in a manner enabling the lighted length to be precisely established, the lead-in wire conductors each having an L shaped configuration whereby one leg having a bent end with its exterior surface which faces the filament which is affixed at a predetermined location on the circumference of a single coil end turn joined thereto while the remaining free leg of each conductor is disposed substantially parallel to the central axis of the filament coil, said bent end joined to said filament so as to avoid electrical shorting between adjacent turns of said filament.

16. Light source means of claim 15 wherein the filament coil is tungsten.

17. Light source means of claim 15 wherein the lead-in conductors are molybdenum.

18. Light source means of claim 15 wherein both the filament coil and lead-in conductors are tungsten.

19. Light source means of claim 15 wherein the lead-in conductors are joined directly to the filament coil by a welding process selected from the group consisting of plasma welding and laser welding.

20. Light source means of claim 15 wherein the free leg of at least one lead-in conductor is aligned substantially coincident with the central axis of the filament coil.

21. Light source means of claim 15 wherein the free leg of both lead-in conductors are aligned substantially coincident with the central axis of the filament coil.

22. Light source means of claim 15 wherein alignment of the respective lead-in conductors is offset with respect to each other.

23. Light source means of claim 25 wherein the filament coil comprises a coiled coil construction.

24. In the manufacture of an electric incandescent lamp which comprises an elongated hermetically sealed light transmissive lamp envelope containing an inert gas filling along with an incandescent refractory metal coiled filament having a linear axis substantially coincident with the longitudinal axis of the envelope, the steps of forming a preliminary filament assembly with an elongated filament coil having a central axis by directly joined to the opposite single end turns thereof refractory metal wire lead-in conductors having an L shaped configuration whereby one leg having a bent end with its exterior surface which faces the filament affixed to a predetermined location on the circumference of the single coil end turn joined thereto while the remaining free leg of each conductor is disposed substantially parallel to the central axis of the filament coil, inserting the filament assembly into the lamp envelope so that the central axis of the coiled filament is substantially coincident with the longitudinal axis of the lamp envelope, and hermetically sealing both ends of the lamp envelope to the free legs of the lead-in conductors, said bent end joined to said filament so as to avoid electrical shorting between adjacent turns of said filament.

25. The lamp manufacture of claim 24 wherein the free leg of each lead-in conductor is joined to a thin refractory metal foil element when forming the filament assembly.

26. The lamp manufacture of claim 25 wherein the foil elements are hermetically sealed to the lamp envelope.

27. The lamp manufacture of claim 24 wherein the lead-in conductors are joined directly to the filament coil by a welding process selected from the group consisting of plasma welding and laser welding.

28. The lamp manufacture of claim 24 wherein the free leg of at least one lead-in conductor is aligned substantially coincident with the central axis of the filament coil.

29. The lamp manufacture of claim 24 wherein alignment of the respective lead-in conductors is offset with respect to each other.

* * * * *